US006491185B1

(12) United States Patent
Azzarello et al.

(10) Patent No.: US 6,491,185 B1
(45) Date of Patent: Dec. 10, 2002

(54) MOLDED CONTAINER INCLUDING PLUG WITH MULTIPLE LOCKING ARMS

(75) Inventors: Francis T. Azzarello, Woodstock, IL (US); Rodolfo Q. Raymundo, Jr., Aurora, IL (US)

(73) Assignee: United States Can Company, Lombard, IL (US)

( * ) Notice: Subject to any disclaimer, the term of this patent is extended or adjusted under 35 U.S.C. 154(b) by 0 days.

(21) Appl. No.: 09/712,613

(22) Filed: Nov. 14, 2000

Related U.S. Application Data

(60) Provisional application No. 60/165,644, filed on Nov. 15, 1999.

(51) Int. Cl.[7] ..... B65D 41/16

(52) U.S. Cl. ..... 220/783; 206/508; 206/515; 220/771; 220/701; 220/789; 220/266; 220/268

(58) Field of Search ..... 220/771, 699–702, 220/669, 675, 789, 780, 268, 266, 783; 206/503, 508, 509, 515, 505

(56) References Cited

U.S. PATENT DOCUMENTS

| | | | | |
|---|---|---|---|---|
| 606,838 A | | 7/1898 | Heins | |
| 1,454,958 A | | 5/1923 | Davies | |
| 2,767,711 A | | 10/1956 | Ernst | |
| 2,828,789 A | | 4/1958 | Groendyk et al. | |
| 2,885,108 A | | 5/1959 | Donoghue | |
| 3,117,691 A | | 1/1964 | Williams | |
| 3,524,566 A | * | 8/1970 | Parks | 220/268 |
| 3,566,946 A | | 3/1971 | MacDonald | |
| 3,794,206 A | * | 2/1974 | De Line et al. | 220/268 |
| 4,004,710 A | * | 1/1977 | Crisci | 220/780 |
| 4,055,270 A | * | 10/1977 | Underwood | 220/256 X |
| 4,090,636 A | | 5/1978 | Norton | |
| 4,125,204 A | * | 11/1978 | Klein | 220/268 |
| 4,144,968 A | | 3/1979 | Shelton | |
| 4,210,258 A | | 7/1980 | Holdt | |
| 4,228,916 A | | 10/1980 | Weingardt | |
| 4,240,568 A | | 12/1980 | Pool | |
| 4,245,753 A | | 1/1981 | Ellis | |
| 4,279,358 A | * | 7/1981 | Jacobs | 220/789 |
| 4,293,080 A | | 10/1981 | Letica | |
| 4,308,970 A | | 1/1982 | Holdt | |
| 4,334,631 A | | 6/1982 | Ballester | |
| 4,349,119 A | | 9/1982 | Letica | |
| 4,356,930 A | | 11/1982 | Roper | |
| 4,375,948 A | | 3/1983 | Holdt | |
| 4,378,895 A | * | 4/1983 | Woinarski | 220/700 X |
| 4,380,305 A | | 4/1983 | Holdt | |
| 4,383,819 A | | 5/1983 | Letica | |
| 4,387,828 A | | 6/1983 | Yates, Jr. et al. | |
| 4,397,404 A | | 8/1983 | Blanchette | |
| 4,452,382 A | | 6/1984 | Holdt | |
| 4,458,825 A | | 7/1984 | Holota | |
| 4,512,493 A | | 4/1985 | Holdt | |
| 4,512,494 A | | 4/1985 | Holdt | |
| 4,518,097 A | | 5/1985 | Milton et al. | |
| 4,524,882 A | | 6/1985 | Bue | |
| 4,530,442 A | * | 7/1985 | Vogel, Jr. et al. | 220/789 |
| 4,572,399 A | * | 2/1986 | Bock | 220/789 |
| 4,574,974 A | | 3/1986 | Holdt | |
| 4,619,373 A | | 10/1986 | Galer | |

(List continued on next page.)

FOREIGN PATENT DOCUMENTS

| | | | |
|---|---|---|---|
| GB | 2245549 | * | 1/1992 |
| JP | 10-101112 | * | 4/1998 |

*Primary Examiner*—Lee Young
*Assistant Examiner*—Robin A. Hylton
(74) *Attorney, Agent, or Firm*—Polster, Lieder, Woodruff & Lucchesi, L.C.

(57) ABSTRACT

A container, capable of construction from polymeric injection molding, comprising a plug and ring closure, the plug having first and second locking arms for extending into the ring, each locking arm having a locking tab located adjacent to a distal end for selectively securing the plug within the ring when the locking tabs reside within an undercut of the ring.

16 Claims, 7 Drawing Sheets

U.S. PATENT DOCUMENTS 4,667,843 A 5/1987 Galer
4,708,245 A 11/1987 Boeckmann et al.
4,799,602 A 1/1989 Collins et al.
4,799,603 A 1/1989 Dudzik
4,878,595 A 11/1989 Uhlig
4,928,846 A * 5/1990 Murrin, Jr. ..... 220/797
4,930,656 A 6/1990 Blanchette
4,949,884 A 8/1990 Dahl
5,027,973 A 7/1991 Drogos
D322,760 S 12/1991 Blanchette
5,097,977 A 3/1992 Straub
5,125,530 A 6/1992 Straub
5,129,537 A 7/1992 Bordner et al.
5,181,626 A * 1/1993 Daenen et al. ..... 220/789 X
5,307,949 A 5/1994 Holdt, Jr. et al.
5,437,386 A 8/1995 Holdt
5,538,154 A 7/1996 Holdt
5,713,482 A 2/1998 Bordner et al.
5,785,201 A 7/1998 Bordner et al.
5,803,298 A * 9/1998 Hausmann ..... 220/700 X
5,842,593 A 12/1998 Holdt
5,913,446 A 6/1999 Holdt, Sr. et al.
5,944,214 A 8/1999 Conti et al.
5,947,320 A 9/1999 Bordner et al.
5,967,363 A * 10/1999 Allen ..... 220/798 X
5,979,691 A 11/1999 Holdt
6,189,725 B1 * 2/2001 Monico ..... 220/698
6,250,494 B1 * 6/2001 Diamond ..... 220/789 X

* cited by examiner

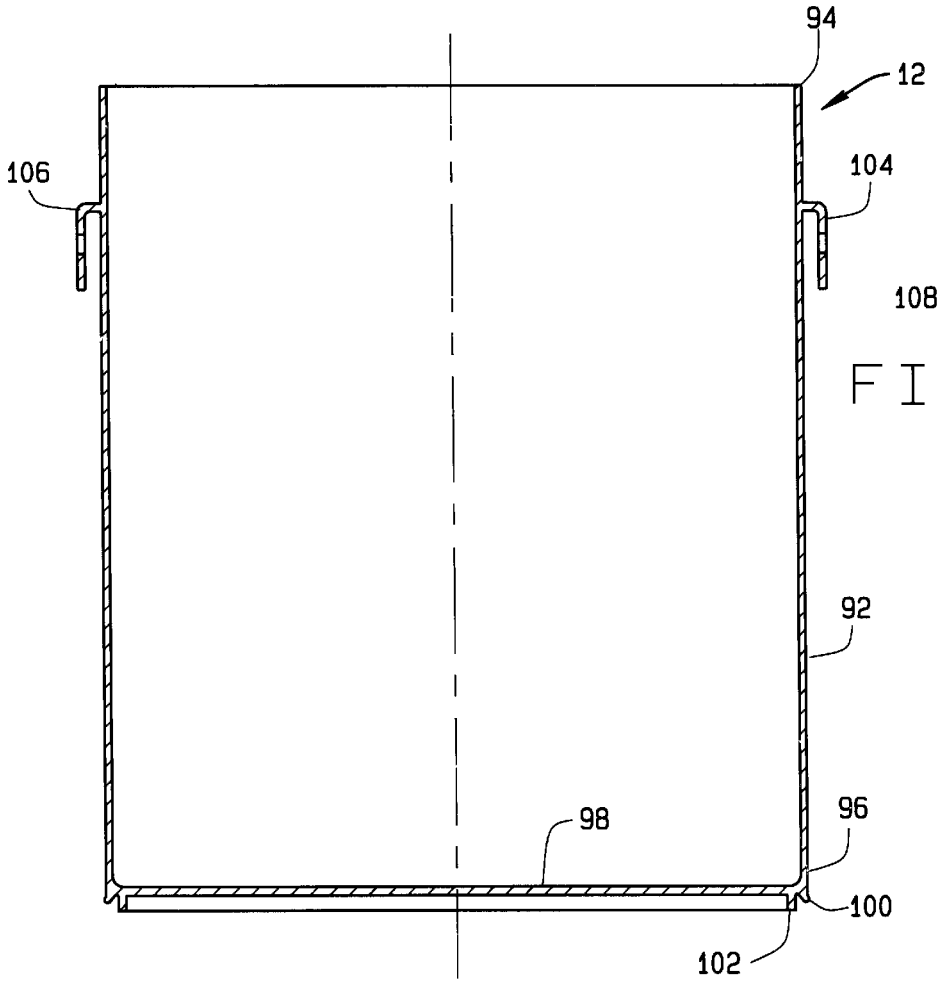
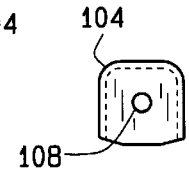
FIG. 7B
FIG. 7A
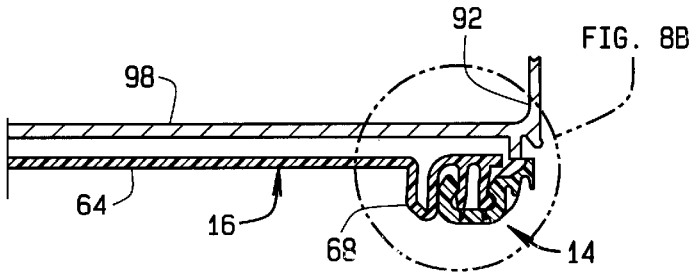
FIG. 8A

MOLDED CONTAINER INCLUDING PLUG WITH MULTIPLE LOCKING ARMS

This application claims priority to U.S. patent application Ser. No. 60/165,644 filed Nov. 15, 1999.

FIELD OF THE INVENTION

The present invention relates generally to plastic containers and closures therefore; specifically to a plastic paint container and a closure therefore.

BACKGROUND OF THE INVENTION

With the increased efficiency of molding techniques for various types of polymeric materials, the container industry, among others, is experiencing a conversion to polymeric materials to take advantage of the many beneficial characteristics of the various polymers which the packaging industry has come to employ. Unlike many other sectors of the packaging industry, the paint container industry has not achieved a successful conversion from the standard steel paint can that has been in existence for many years. While these steel cans provide high structural integrity and good sealing, they are also susceptible to denting and rusting.

Filling and sealing of paint containers is typically performed by automated equipment. This usually includes filling a container with a white base paint and then capping the container with a plug (commonly referred to as a lid). Between the filling operation and the capping operation, the plug is placed on the filled container by a lid dropper/placer. At the lid dropper/placer the plugs are manually loaded into a trough and indexed down onto the containers. Accordingly, the profile of the plug must consider its movement through the indexing trough of this industry standard equipment, so that the plugs do not jam, as well as the requirements of sealing the container.

As the plug is transferred to the container, it must "find it's center" and the ring (the portion of the container designed to accept the plug) and plug should be profiled to facilitate this. The plug and corresponding ring must allow for insertion of the plug by automated equipment as well as re-sealing by the consumer. However, the plug and ring must also provide security against unwanted release of the plug from the ring while allowing the consumer to remove the plug without undue force.

Typically, after paint containers are filled with the white base paint and then capped, a label and then a bail (i.e. handle) are applied, and container is then packed in a carton. Alternatively, some manufacturers may label, bail and then fill. Cartons of full containers are shipped and stacked vertically in warehouses on pallets and then re-shipped to retailers for sale. The retailer removes the plug, ads tint color and re-closes the plug. Alternatively, some retailers punch a hole in the plug, add tint color through the hole and install a plastic stopper in the hole.

When paint containers are filled and capped, air is typically trapped in the headspace between the liquid level and the plug. When the plug compresses the air, the internal pressure of the container is increased and acts in conjunction with the weight of the liquid product forcing the bottom profile of the container to distend. Extensive distention may interfere with the proper operation of some capping, bailing or packaging equipment and may render the containers unstable in stacking.

Paint containers are generally stored in warehouses in vertical stacks up to, or exceeding, 12 containers high. A container's ability to sustain an axial load is therefore important to prevent buckling of the container under the weight of those containers above it. Prior to this invention, it was thought that the axial load resistance of a plastic container would be directly proportional to the plastic material and sidewall thickness of the container. However, because injection molding the body of a plastic container requires that the sidewall be at some minimal angle to its central axis to allow release of the sidewall from the mold, prior plastic containers gradually thinned the sidewall thickness from bottom to top in order to provide the necessary release angel. The thickness at the base of such sidewalls consumed high amounts of resin.

Accordingly, there is a need for a plastic container adapted to contain standard volumes of paint and which will allow for relatively easy opening and sealing of the plug without being susceptible to accidental opening and which container will have dimensions necessary to be compatible with standard filling, capping, labeling and bailing equipment in the industry while being capable of sustaining the axial loading and other rigors to which paint cans are typically subjected.

SUMMARY OF THE INVENTION

It is a primary objective of the present invention to provide a paint can that is resistant to denting and rusting.

It is an object of the invention to provide a container having a plug closure capable of sealing the inside of the container from unwanted exposure to the atmosphere while minimizing insertion force of the plug.

It is another object of the invention to provide a container having a plug closure capable of sealing the inside of the container from unwanted exposure to the atmosphere while minimizing removal force of the plug without undue exposure to accidental release of the plug from the container.

It is a further object of the invention to provide a container having a body capable of sustaining axial loading while minimizing material necessary to construct the body.

It is yet another object of the invention to provide a container having high hoop strength resistant to ovalizing.

It is another object of the present invention to provide a container having a bottom panel capable of preventing substantial distention while minimizing material necessary to construct the body.

It is an additional object of the present invention to provide a polymeric container having a plug closure capable of sealing the inside of the container from unwanted exposure to the atmosphere while minimizing insertion force of the plug.

It is another object of the invention to provide a polymeric container having a plug closure capable of sealing the inside of the container from the unwanted exposure to atmosphere while minimizing removal force of the plug.

It is a further object of the invention to provide a polymeric container having a body capable of sustaining axial loading while minimizing material necessary to construct the body.

It is yet another object of the invention to provide a polymeric container having high hoop strength resistant to ovalizing.

It is another object of the present invention to provide a polymeric container having a bottom panel capable of preventing substantial distention while minimizing material necessary to construct the body.

It is an additional object of the invention to provide a polymeric paint container.

It is still another object of the invention to provide a container constructed a polymeric resin to approximate the dimensions of a steel paint can necessary to allow manipulation of the container by standard filling and handling equipment employed for the steel paint can.

The above objects and other objects and features of the invention will be readily appreciated by one of ordinary skill in the art from the following detailed description of the preferred embodiment for carrying out the invention when taken in connection with the following drawings.

BRIEF DESCRIPTION OF THE DRAWINGS

FIG. 7A is a cross-sectional view of one embodiment of the body of the container depicted in FIG. 1.

FIG. 7B is an elevational view of an ear of body depicted in FIG. 7A.

FIG. 8A is a partial cross-sectional view of two containers of the embodiment depicted in FIG. 1, stacked one upon the other.

DETAILED DESCRIPTION OF THE PREFERRED EMBODIMENTS

Figure 1:
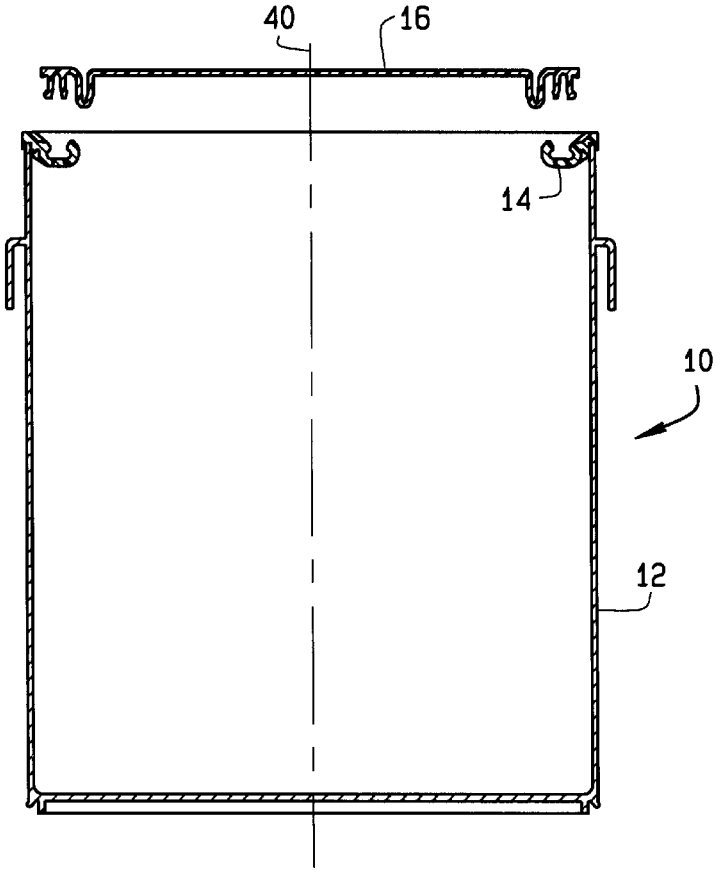
FIG. 1 is a cross-sectional view of one embodiment of a container and closure according to the present invention.

The embodiment of the present invention depicted in FIG. 1 comprises a container 10 having a body 12, a closure ring 14 (referenced herein as "closure ring" or "ring") and a closure plug 16 (referenced herein as "closure plug" or "plug") for selective insertion or removal from the ring 14 to seal or open the container 10, respectively. In one embodiment, each of the body 12, the ring 14 and the plug 16 are injection molded from polymeric materials such as, by way of example only, polypropylene or high density polyethylene. These materials provide the container 10 with rust and dent resistance while, in the configuration presented herein, retaining the structural integrity required for a paint can, such as the ability to sustain axial loading and fracture resistance. Other polymeric materials are also contemplated as will be recognized by one of ordinary skill in the art. However, while the container 10 of the present invention is readily susceptible to construction by polymeric injection molding, the structural features of the present invention are not limited to construction from polymeric material or an injection molding process. The container 10 may comprise combinations of materials. For example, it is contemplated that the body 12 of the present invention could be comprised of steel, aluminum or other metal, while the ring 14 and plug 16 may be comprised of a polymer. Alternatively, the ring 14 and plug 16 could be constructed from a metal such as steel. Other combinations and materials will be recognized by one of ordinary skill in the art.

Figure 2A:
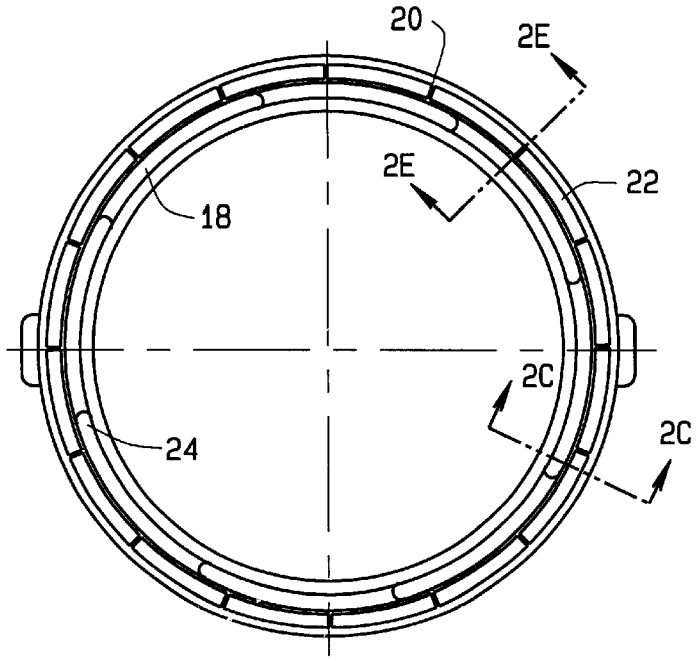
FIG. 2A is top-side view of the ring of the container depicted in FIG. 1.
Figure 2B:
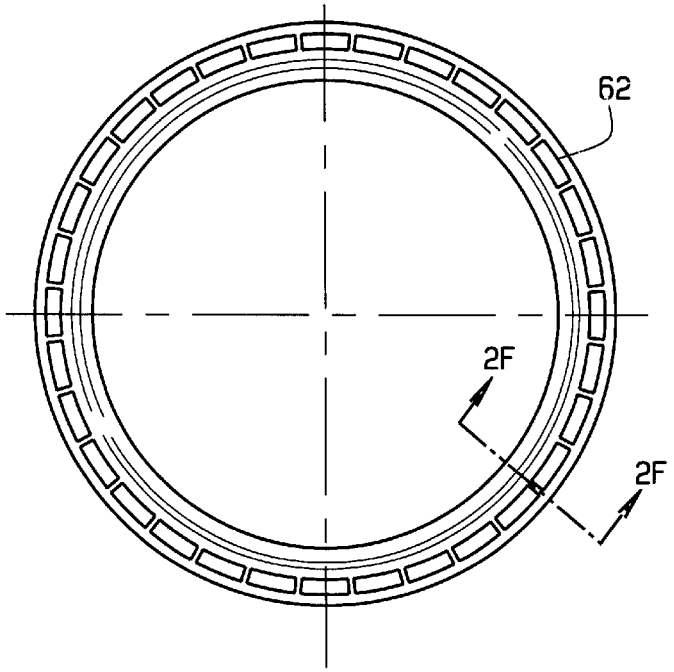
FIG. 2B is a bottom-side view of the ring depicted in FIG. 2A.

FIGS. 2A–2B depict the embodiment of the ring 14 depicted in FIG. 1. The ring 14 comprises an annular groove 18 to accommodate the plug 16 for sealing the container 10. An annular first angled centering ledge 20 is located radially outward of the annular groove 18 and comprises a plurality of notches 22 therein. The annular groove 18 may optionally comprise a plurality of tabs 24 located in the lowermost portion thereof. The tabs 24 are preferably constructed, as discussed in more detail below, to allow their displacement from the plane defined by the lowermost portion of the annular groove 18 creating a drain hole 26 at the bottom of the groove 18 as depicted in FIG. 2D. In the depicted embodiment, the tabs 24 are created by a reduced thickness of material around its borders including only one end so as the tab 24 is pushed toward the inside of the container 10, the reduced material is fractured allowing the tab 24 to be displaced into the container 10 without disengaging from the ring 14 completely and falling into the liquid within the container 10. Opening one or more of the tabs 24 creates drain holes 26 in the groove 18 for draining back into the container 10 any paint, or other contents of the container 10, which may have come to reside within the groove 18. The drain holes 26 tend to prevent buildup in the groove of materials that may otherwise prevent full and proper insertion of the plug 16 into the ring 14.

Figure 3:
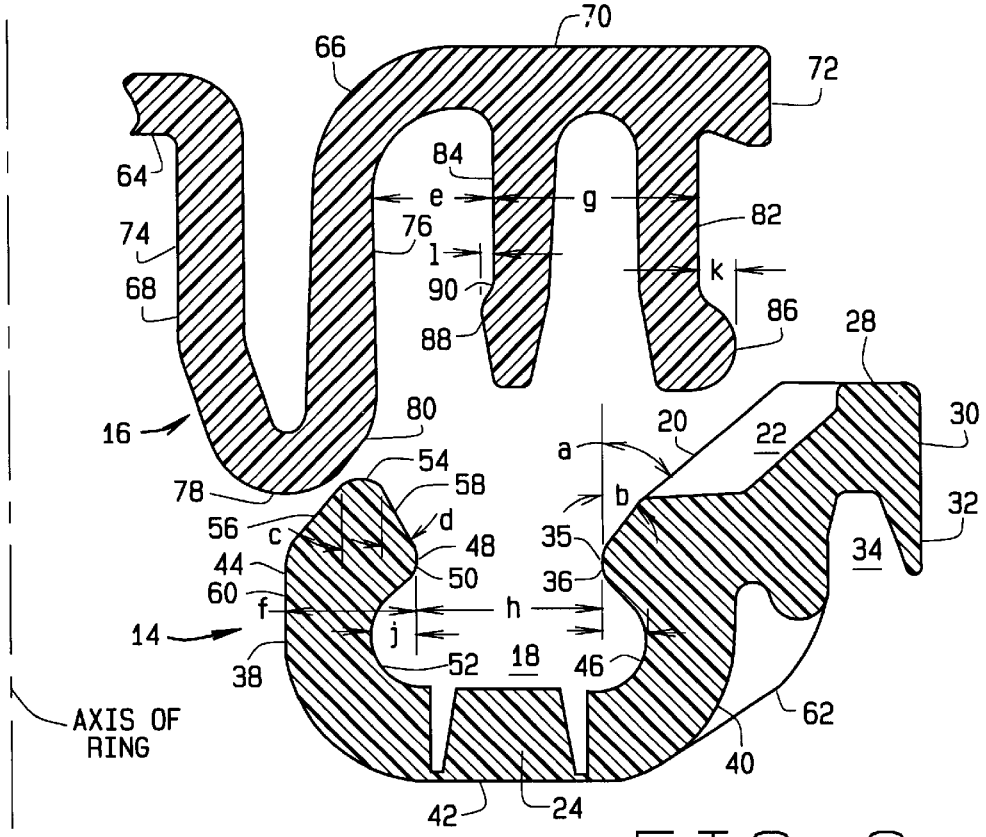
FIG. 3 is a cross-sectional view of the ring of FIGS. 2A–F with the plug of FIGS. 4A–4B positioned adjacent thereto illustrating their centering features.

As depicted in FIG. 3, the ring 14, when taken in cross-section, comprises an upper land 28 extending between the first angled centering ledge 20 and a ring outer diameter 30. The ring outer diameter 30 extends downwardly from the upper land 28 to form a flange 32. The flange 32 defines an annular channel 34 for receiving the body 12 as discussed below. The first angled centering ledge 20 extends downward beyond the lower extremity of the notches 22 to a first sealing diameter 35 which may optionally comprise a small flat 36 that may be oriented substantially parallel to the axis 40 of the ring 14. A jaw 38 extends from the lower end of the first angled centering ledge 20 to form the groove 18. The jaw 38 comprises an inner leg 40 at its proximate end extending contiguously from the first sealing diameter 35 to a lower leg 42 which forms the bottom of the groove 18 and extends into an outer leg 44 at the distal end of the jaw 38. The inner leg 41 is formed to define a first undercut 46 extending under the first sealing diameter 35 as shown. The outer leg 44 comprises a second sealing diameter 48 and, like the first sealing diameter 35, may optionally comprise a small flat 50 which may be oriented substantially parallel to the axis 40 of the ring 14. The outer leg 44 is formed to define a second undercut 52 extending under the second sealing diameter 48. The groove 18 is defined to extend from adjacent to the first sealing diameter 35 to adjacent to the second sealing diameter 48. The outer leg 44 of the jaw 38 terminates in a peak 54 which divides a second angled centering ledge 56 from an angled ledge 58 that extends to the second sealing diameter 48. The outer leg 44 further comprises a third sealing diameter 60 extending into the second angled centering ledge 56. As with the first and second sealing diameters 35, 48, the third sealing diameter may optionally comprise a flat which may be oriented substantially parallel to the axis 40 of the ring 14. When employed, the tabs 24 reside in the lower leg 42 of the ring 14 to allow drainage from the lowermost portion of the groove 18. The ring 14 is configured to attach to the container body 12 at the annular channel 34, as described below, with the jaw 38 extending from the body 12 in a cantilever fashion. Accordingly, one or more stiffening ribs 62 extending from proximate to the annular channel 34 to the inner leg 41 of the jaw 38 may be desirable to control the flexure of the jaw 38 during insertion of the plug 16 into the ring 14 or subsequent removal therefrom.

Figure 2C:
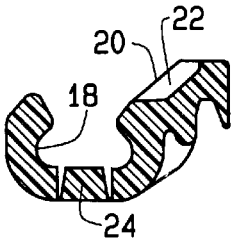
FIG. 2C is a cross-sectional view of the ring depicted in FIG. 2A taken through line 2C—2C.
Figure 2D:
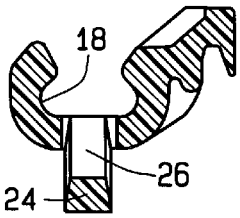
FIG. 2D is a cross-sectional view of the ring as depicted in FIG. 2C with a tab displaced from the ring to create a drain hole.

FIG. 2C illustrates a cross-section of the ring 14 taken through a portion thereof comprising the drain tab 24 and a notch 22 in the first angled centering ledge 20. FIG. 2D illustrates the drain tab 24 depressed to create the drain hole 26 at the bottom of the groove 18. The drain tabs 24 are formed by substantially limiting the amount of material present about the perimeter of the desired tab as depicted in FIG. 2C, by processed known to those of ordinary skill in the art. Thus, force applied to the desired tab will fracture or shear that limited material and create the desired hole 26. Although the depicted configuration of tabs 24 has been found operative, other configurations are contemplated and will be recognized by one of ordinary skill in the art. In another embodiment (not depicted), it is also contemplated that drain holes may optionally be made available by limiting the amount of material present, as done about the perimeter of the depicted tabs 24, throughout the entire area of the desired tabs, rather than just at the perimeter, leaving a film to cover the drain hole 26. In this embodiment, the drain holes 26 would be accomplished by puncturing the film. Regardless of the configuration, the number and placement of the tabs about the ring 14 will depend on the size of the ring and the tabs 24 themselves in order to accomplish the desired drainage.

Figure 2E:
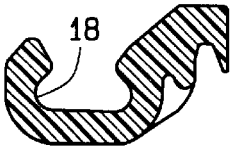
FIG. 2E is a cross-sectional view of the ring depicted in FIG. 2A taken through line 2E—2E.
Figure 2F:
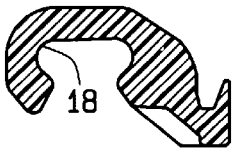
FIG. 2F is a cross-sectional view of the ring depicted in FIG. 2B taken through line 2F—2F.

FIG. 2E illustrates a cross-section of the ring 14 taken through a portion thereof not having the drain tabs 24 or a notch 22. FIG. 2F illustrates a cross-section of the ring 14 taken through a portion thereof having a stiffening rib 62. The size and number of the stiffening ribs 62 about the ring 14 will be dictated by the desired stiffness of the jaw 38. It is contemplated that the stiffening rib 62 could run annularly about the entire jaw 38. The various embodiments of the ring 14 are preferably manufactured by standard injection molding techniques known to one of ordinary skill in the art. In the depicted embodiment, the features of the ring 14 set forth above, run about the entire ring 14 in an annular fashion except for the notches 22, the tabs 24 and the stiffening ribs 62 that may be placed intermittently about the ring 14.

Figure 4A:
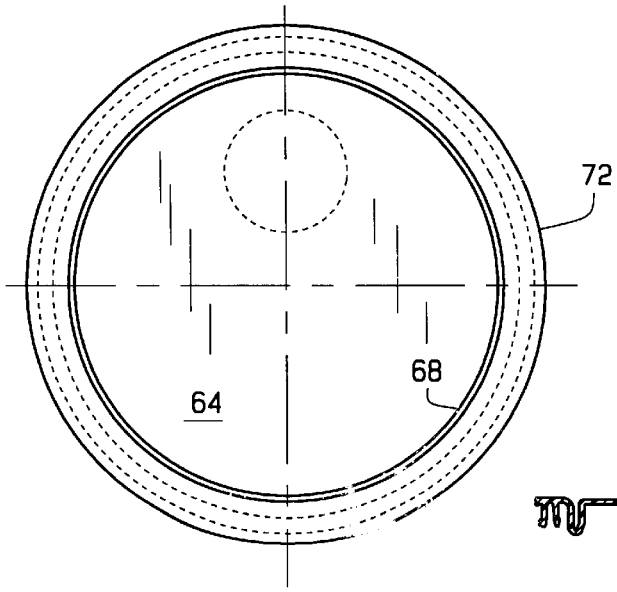
FIG. 4A is a top-side view of the plug depicted in FIG. 1.
Figure 4B:
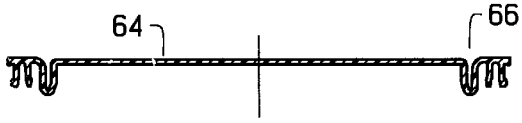
FIG. 4B is a cross-sectional view of the plug depicted in FIG. 4A.

Details of the plug 16 are depicted in FIGS. 4A–B as well as FIG. 3. The plug 16 comprises a disc 64 circumscribed by a sealing member 66 extending therefrom. The disc 64 may optionally comprise a rough texture (not depicted) to allow easy adhesion of any "skin" forming on the paint within the container 10, thus removing the skin from the remaining usable paint. Additionally, the disc 64 may optionally comprise a punch-through disc 67 known to those in the art for facilitating the addition tint to a base paint within the container 10. The punch-through disc 67 may be constructed by limiting portions of the thickness of the disc 64 about some or the entire perimeter of the punch-through disc 67 during, for example, the injection molding process. The sealing member 66 extends integrally from the perimeter of the disc 64 and comprises a U-shaped arm 68 extending from the disc 64 and a lip 70 extending from the distal end of the U-shaped arm 68 to a plug outer diameter 72. The U-shaped member 68 comprises a first arm 74 extending integrally from the disc 64 and a second arm 76 extending between the first arm 74 and the lip 70. The first and second arms 74, 76 converge at a peak 78 and the second arm 76 comprises a centering surface 80 adjacent to the peak 78. The centering surface 80 may comprise a flat as depicted in FIG. 3 and is intended to come into contact with the second angled centering ledge 56 of the ring 14 during initial stages of inserting the plug 16 into the ring 14. The lip 70 comprises a first locking arm 82 and a second locking arm 84 extending downward from therefrom with the second locking arm 84 disposed proximate to the U-shaped member 68 and the first locking arm 82 disposed farther on the lip 70 from the U-shaped member 68. The first locking arm 82 comprises a first locking tab 86 disposed at the distal end thereof and the second locking arm 84 comprises a second locking tab 88 at the distal end thereof. As discussed below, the first and second locking tabs 86, 88 are configured to be disposed within the first and second undercuts 46, 52 of the ring jaw 38, respectively, when the plug 16 is fully inserted into the ring 14 as depicted, for example, in FIG. 5G. In the depicted embodiment, the first locking tab 86 protrudes outward from the first locking arm 82 in a bulbous manner approximating a semi-circle, arising abruptly from the first locking arm 82. The second locking tab 88 protrudes from the second locking arm 84 in a more gradual manner at an upper end 90 of the second locking tab 88 and is defined by a greater radius of curvature than the first locking tab 86. After the second locking tab 88 gradually arises from the second locking arm, it gradually angles back toward the second locking arm 84 along an angled flat until it reaches the free end of the second locking arm 84. In one embodiment of the present invention, both the first and second locking arms 82, 84 extend from the lip 70 to their distal end to measure 9/32 inches, the first locking tab 86 is configured to protrude 0.040 inches from the side of the first locking arm 82, and the second locking tab 88 is configured to protrude 0.013 inches from the second locking arm 84. One of ordinary skill in the art will recognize that other dimensions may prove operative, consistent with the objectives of the invention.

The first and second locking arms 82, 84 are shown as substantially flat between the lip 70 and their respective locking tabs 86, 88 to provide a flat surface to interface the first and second sealing diameters 35, 48 respectively. The first and second locking arms 82, 84 extend from the lip 70 in a cantilever fashion allowing flexure of their respective locking tabs 86, 88 during insertion and removal of the plug 16 from the ring 14. The lip 70 extends beyond the first locking arm to the plug outer diameter 72 to provide an overhang under which a tool 90 may be placed to assist in removing the plug 16 from the ring 14 when inserted therein as depicted in FIG. 5G and FIGS. 6A–E. In the depicted embodiment of the present invention as a paint can, the plug outer diameter 72 and, optionally, the diameter of the first locking arm 84 are equivalent to their standard counterparts of a steel paint can plug to allow the plug 16 of the present invention to be employed with pre-existing equipment, such as lid droppers, employed to move or manipulate paint can plugs.

The first and second angled centering ledges 20, 56 are offset from perpendicular to the axis 40 of the ring 14 by an angle that is steep enough to allow plug to slide inward, with some help from vibration transmitted to the plug 16 from, for example, a moving conveyor belt on which the container 10 may rest, yet not so steep that the ring would need to be too tall and thus use an excess amount of resin and detract from the volumetric capacity of the can. The plug centering surface 80 may be disposed at an angle complementary to the angles of the first and second angled centering ledges 20, 56. Additionally, all elements of the sealing member 66 and the ring 14, including the angles of the first and second angled centering ledges 20, 56 and the plug centering surface 80, are optimized to minimize the vertical force required to accomplish full insertion of the plug 16 into the ring 14 thus minimizing the distortion of the each to assure that the plug 16 may be brought properly to rest within the ring 14, as depicted in FIG. 5G. In one embodiment, it has been found that these goals are sufficiently accomplished when the first angled centering ledge 20 may be split into angle a (extending between the upper land 28 and the lower end of the notch 22) and angle b (extending from the lower end of the notch 22 to the first sealing diameter 35), angle c along the second angled centering ledge 56, and angle d along the angled centering ledge 58. Each of angles a–d are measured from parallel to the axis 40 of the ring 14. In one embodiment, it has been found that the following specific angles facilitate the centering function described above: angle a=50°, angle b=35°, angle c=40° and angle d=30°. In the depicted embodiment, the first angled centering ledge 20 and the opposing angled ledge 58 are each directed downward toward the groove 18 and terminate in the first and second sealing diameters 36, 48, respectively. The first and second sealing diameters 36, 48 define the entrance to the groove 18 which widens thereunder into the first and second undercuts 46, 52 for accommodating the first and second locking tabs 86, 88. Thus configured, with the plug 16 and ring 14 juxtaposed as depicted in FIG. 3, upon insertion, the first locking tab 86 would contact the first angled centering ledge 20 and the plug centering surface 80 would contact the second angled centering surface 56 and guide the first and second locking tabs 82, 84 toward the ring groove 18. The second locking tab 88 will encounter the ring angled ledge 58 when the plug 16 is centered.

From the foregoing, it will become evident to one of ordinary skill in the art that the plug 16 and ring 14 will provide a centering function to center the plug 16 within the ring 14 from an off-center alignment. This centering function will reduce the accuracy required of humans or automated machinery designed to align the plug 16 within the ring 14 for sealing. From FIG. 3 it will be noted that in the depicted embodiment of the present invention the off-center distance from which the centering function may center the plug 16 is limited by the distance between the plug U-shaped member peak 78 and the ring outer leg peak 54, as measured perpendicular to the axis 40, when the plug 16 is fully inserted within the ring 14 as depicted in FIG. 5G. That is, if the U-shaped member peak 78 of the plug 16 were positioned beyond the ring outer leg peak 54, then the angled ledge 58 would direct the plug U-shaped member 68 toward the annular groove 18 rather than the first and second locking arms 82, 84. It has been found that facilitating centering of the plug 16 from substantially 0.25 inches from center is sufficient for alignment by both humans and mechanical equipment.

Figure 5A:
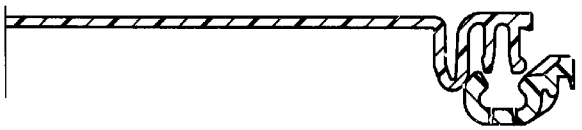
FIGS. 5A–F are cross-sectional views of the ring of FIGS. 2A–F accommodating the plug of FIGS. 4A–4B during various stages of insertion and indicating the distortion imparted to each during insertion of the plug into the ring.
Figure 5B:
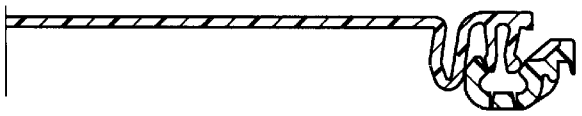
Figure 5C:
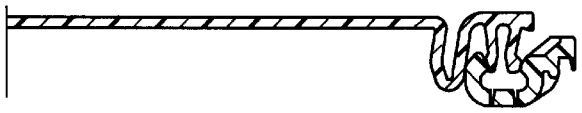
Figure 5D:
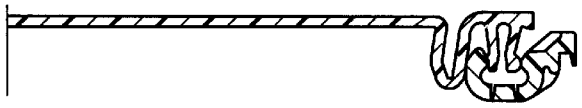
Figure 5E:
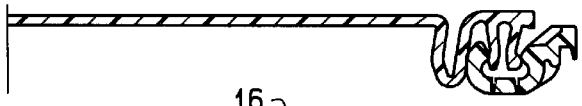

Various stages of insertion of the plug 16 into the ring 14 are depicted in FIGS. 5A–F. FIG. 5A depicts the plug 16 centered to the ring 14. When centered, the first locking tab 86 of the plug 16 will be in contact with the ring first angled centering ledge 20 and the second locking tab 88 will be in contact with the ring angled ledge 58 as depicted in FIG. 5A. FIGS. 5B–5F depicts the deformation of the plug 16 and the ring 14 during the initial stage of insertion as the first and second locking tabs 86, 88 ride the first angled centering ledge 20 and the angled ledge 58 past the first and second sealing diameters 35, 48 and into the groove 18. As depicted, the ring outer leg 44 becomes forced between the second arm 76 of the U-shaped member 68 and the second locking arm 84 as the plug 16 proceeds into the ring 14. The width of the ring outer leg 44 at the second sealing diameter 48 imparts a relatively greater flexure of the second locking arm 84 than the first locking arm 82 which need only flex an amount sufficient to allow the first locking tab 86 to pass the first sealing diameter 35. Accordingly, relatively less force is required to direct the first locking tab 86 into the ring first undercut 46 than is required to direct the second locking tab 88 into the ring second undercut 52. This, taken in conjunction with the fact that the ring will flex under insertion force in a cantilever fashion, as described above, will dictate that the first locking tab 86 will enter into the ring first undercut 46 before the second locking tab 88 will enter into the ring second undercut 52 as the plug 16 is inserted into the ring 14 as depicted in FIGS. 5A–5F. In one embodiment, it has been found that configuring the plug 16 to have a flex modulus of approximately 75% of the ring 14 flex modulus will assist in limiting distortion of the ring 14 during insertion of the plug 16 and assist proper seating within the ring 14. For example, it has been found that molding the plug 16 of a polymer having a flex modulus of 135 Kpsi and molding the ring 14 of a polymer having a flex modulus of about 180 Kpsi will assist proper insertion in the manner described. Other flex modulus and ranges thereof are contemplated and will become apparent to one of ordinary skill in the art from the foregoing.

Roller-type capping equipment (often referenced as Roller Cappers) present a particular challenge to accomplishing full insertion of the first locking tab 86 into the groove 18 when the plug is made of a flexible polymer. Roller cappers pass a roller across the top of the plug 16 with a vertical force pressing the plug 16 into the ring 14. The roller passes from one edge of the plug 16 to the other. Because the polymeric plug 16 is flexible, it may tend to bunch as the roller passes to the far end of the plug 16 creating an excess of material and difficulties in properly inserting this bunched material of the plug 16 within the ring 14. In one embodiment, it has been found that maintaining the maximum diameter of the first locking tab 86 within about 0.075–0.085 inches of the diameter of the first sealing diameter 35 will assist in facilitating full and proper seating of the plug 16 within the ring 14 with roller capper type capping equipment.

Figure 5F:
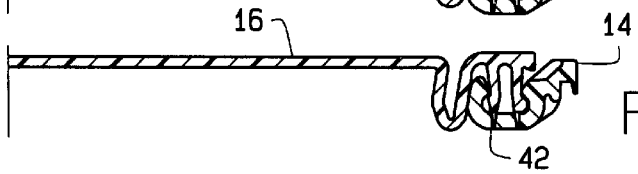
Figure 5G:
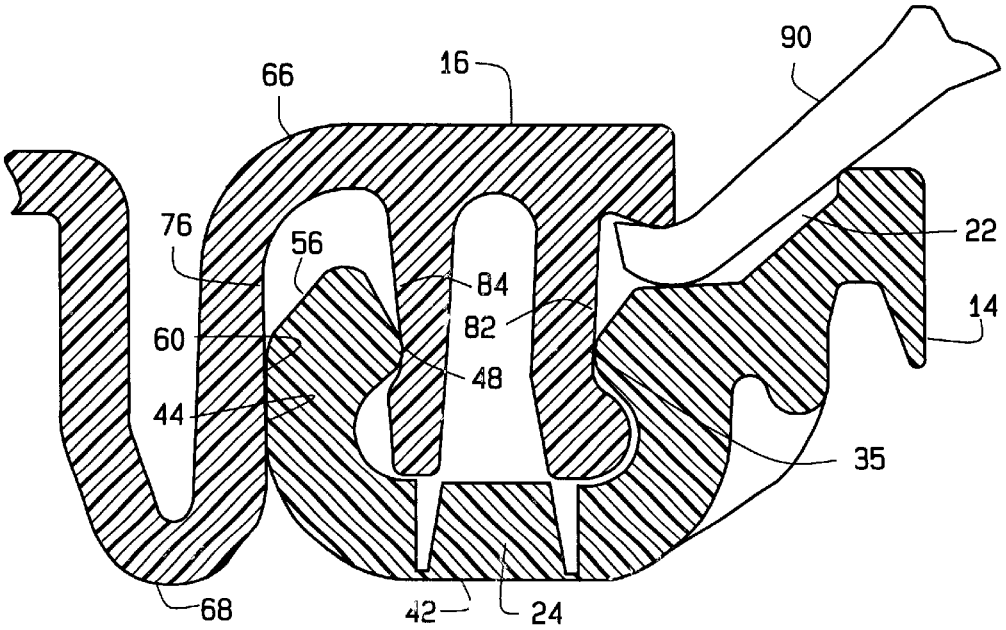
FIG. 5G is a cross-sectional view of the ring of FIGS. 2A–2F accommodating the plug of FIGS. 4A–4B with the plug fully inserted into the ring.

As can be seen in FIGS. 5F and 5G, when the plug 16 is fully inserted, the ring 14 remains distorted from its relaxed configuration. Specifically, the lower leg 42 is flexed downward in a cantilever fashion and the outer leg 44 is slightly straightened. Similarly, the ring outer leg 44 has distorted and rotated the U-shaped member 68 inward while flexing the second locking arm 84 outward in a cantilever fashion. According to well known material principles known to those of ordinary skill in the art, this distortion biases the U-shaped member second arm 76 into the third sealing diameter 60 (which includes the rounded transition into the second angled centering ledge 56) and biases the second locking arm 84 into the second sealing diameter 48. Likewise, the first locking arm 82 is flexed inward by the first sealing diameter 35 and biases the first locking arm 82 into the first sealing diameter 35. The bias between the plug 16 and the ring 14 at each of these three sealing diameters 35, 48, 60 extends annularly about the entire diameter of the plug 16 and ring 14 to create three separate and distinct seals between the interior and the exterior of the plug/ring interface. Thus, when the ring 14 is attached to the body 12, these three seals will impede egress of the contents of the body 12 and ingress of atmospheric air while the tabs 24 remain undepressed. The notches 22 in the first angled centering ledge 20 should not extend into the first sealing diameter 35. Otherwise, the notches 22 would allow air or contents of the container 10 to circumvent the seal created at the first sealing diameter 35. This is especially important because once the tabs 24 are depressed the seal at the first sealing diameter 35 becomes the only seal between the contents of the container and the atmosphere. As discussed below, the elements of the sealing member 66 and the ring 14 are configured to maximizing resistance to accidental release of the plug 16 from the ring 14, once full insertion is complete, and minimize the effort required to intentionally open and re-open the container 10, such as by tool 90.

Figure 6A:
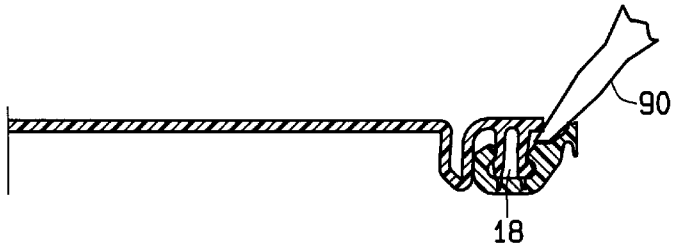
FIGS. 6A–6E are cross-sectional views of the plug of FIGS. 4A–4B being removed from the ring of FIGS. 2A–2F and illustrating the distortion imparted to each during the removal of the plug from the ring.
Figure 6B:
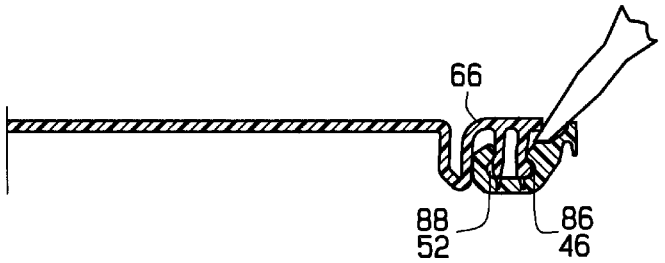
Figure 6C:
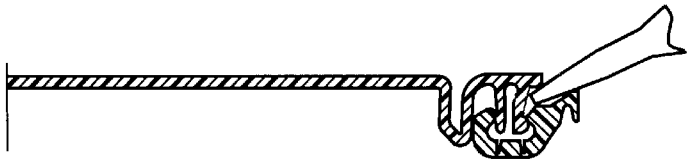
Figure 6D:
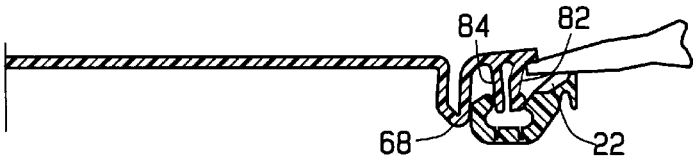
Figure 6E:
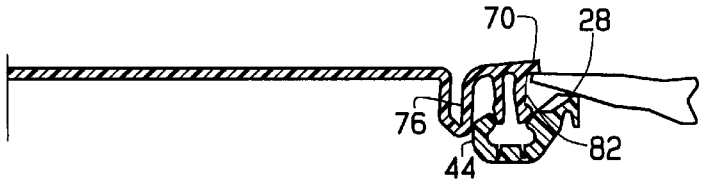

Various stages of removal of the plug 16 from the ring 14 are depicted in FIGS. 6A–6E. FIG. 6A depicts the tool 90 placed into one of the slots 22 in the first angled centering ledge 20, allowing the tool 90 to be located under the plug lip 70 between the plug outer diameter 72 and the first locking arm 82. Using the ring upper land 28 for leverage, the tool 90 may raise the plug sealing member 66 from the ring groove 18. The tool 90 will impart a direct vertical force to the first locking arm 82. The U-shaped member second arm 76 and the lip 70 will flex from the force imparted by the tool 90 and, because the ring outer arm 44 is wedged between the U-shaped member 68 and the second locking arm 84, impart a moment to the second locking arm 84 tending to raise the second locking tab 88 out of the second undercut 52. Because the second locking tab 88 protrudes from its locking arm 84 less abruptly and a smaller distance than does the first locking tab 86 from its locking arm 82, the second locking tab 88 will release from the second undercut 52 under a lesser force than required to remove the first locking tab 86 from the first undercut 46. That is, the greater size of the first locking tab 86 and its more abrupt extension from the first locking arm 82 requires greater distortion, and therefore force, to be imparted to the first locking arm 82 before the first locking tab 86 will be dislodged from the first undercut 46. Thus, as will be recognized by one of ordinary skill in the art, the difference in size and contour between the first and second locking tabs complements the difference in the magnitude of upward force imparted to the locking arms 82, 84 so that the first and second locking tabs 86, 88 may release at substantially the same time. The entire sealing member 66 will therefore be displaced substantially evenly from the ring 14 avoiding undue distortion of the plug 16 and ring 14 and avoiding undue effort to open the container 10.

The opposing first and second locking tabs 86, 88 being biased into the first and second undercuts 46, 52 when the plug 16 is fully inserted into the ring 14 minimizes insertion force, maximizes resistance to accidental release of the plug 16 from the ring 14 while minimizing the force necessary to intentionally open and re-open the container 10 such as by tool 90. The relatively large and abrupt contour of the first locking tab 86 acts to resist unintended removal from the ring 14. In order to accomplished the seals at the first, second and third sealing diameters 35, 48, 60 the distortion of the plug 16 and ring 14 as depicted and discussed is dictated by the dimensions of the plug sealing member 66 and the ring 14 to create interference fits therebetween. Preferably, these dimensions will create seals at the three sealing diameters 35, 48, 60 having at least 900 psig of contact pressure at each to minimize ingress of air or egress of the contents of the container. The following dimensions, as depicted in FIG. 3, have been found to achieve this goal: e=0.100 inches, f=0.140 inches, g=0.204 inches, h=0.186 inches, i=0.045 inches, j=0.045 inches, k=0.040 inches, and l=0.013 inches. Other dimensions are contemplated and will be recognized by one of ordinary skill in the art to facilitate the objectives of the present invention.

One embodiment of the body 12 is depicted in FIG. 7A as comprising a sidewall 92 having an upper end 94 and a lower end 96. The body 12 also comprises a bottom panel 98 extending contiguously across the body sidewall lower end 96 to seal off the bottom end of the body 12. While the bottom panel 98 is depicted as flat, other configurations are contemplated to increase the rigidity of the bottom panel 98. An outer bead 100 extends downward from the sidewall 92 and is angled slightly outward from the sidewall 92. An inner bead 102 extends substantially straight downward from the bottom panel adjacent to the outer bead 100. The inner and outer beads 100, 102 extend about the entire body 12 in an annular fashion. Because the outer bead 100 is angled outward from the sidewall 92, it defines the outermost diameter proximate to the sidewall lower end 96 and acts to separate the sidewalls 92 of adjacent containers 10 when set one next to the other. The sidewall 92 of each container, and any label thereon, is thus protected from damage by the sidewall 92 of an adjacent container 10. The inner bead 102 defines the lowermost portion of the container 10 and substantially defines a single plane on which the container 10 may rest upright. Although the outer and inner beads 100, 102 could be combined into a single bead, it is preferred to employ the two distinct beads 100, 102 as depicted to facilitate uniform cooling and minimize warpage during the molding and cooling process.

The bottom panel 98 is displaced from the surface on which the container 10 rests by the inner bead 102 to protect the bottom panel 98 from encountering the surface and disrupting the upright stability of the container 10 when it becomes distended. In one embodiment, the inner bead 102 extends 0.145 inches from the bottom panel 98. With an inner bead 102 of this height, a bottom panel 98 with a diameter of 6.450 inches and a thickness of 0.074 inches has been found to prevent distending of the bottom panel 98 beyond the lower end of the inner bead 102 under normal conditions experienced by a paint can.

The body sidewall 92 increases in diameter slightly and constantly from its lower end 96 to its upper end 94 while maintaining a substantially uniform thickness throughout. The increase in sidewall 92 diameter defines an angle with respect to the axis 40 to provide the necessary release angle of the body 12 from the mold in the injection molding process. It has been found that an angle of 0°–6' is minimally sufficient to facilitate such release without undue damage to the sidewall 92. This angle may be achieved by an outer diameter of 6.580 inches at the body sidewall lower end 96 and an outer diameter of 6.608 inches at the body sidewall upper end 94 with a sidewall height of 7.370 inches between the body sidewall lower end 96 and upper end 94. It has also been found that a sidewall angle of 0°–9' will also provide a proper release from the mold without undue damage to the sidewall 92. By maintaining the sidewall 92 thickness constant while facilitating stripping of the body from the mold, the resin required to injection mold the body is substantially reduced over prior art containers that employed a tapered sidewall. It has been found that the ability of the sidewall 92 to sustain axial loading is not diminished over prior art containers despite the reduction of resin employed in the present sidewall 92 because the thinnest portion of the prior art tapered sidewalls represented the weakest portion and that which would buckle first under loading. That is, a sidewall is no stronger than its thinnest portion for purposes of axial loading and the resin employed to constitute additional sidewall thickness in portions other than the thinnest portion thereof does not contribute to the ability of the sidewall to sustain axial loading. By maintaining the sidewall 92 of the present invention at a constant thickness, the entire sidewall 92 may be maintained at the minimum necessary thickness without waste of resin. It has been found that for the depicted embodiment of a paint can, a sidewall 92 thickness of 0.070 inches will withstand the rigors to which it is typically subjected. The uniform thickness of the sidewall 92 also substantially reduces the tendency for warpage or sinks to form in the sidewall 92 during cooling.

In the depicted embodiment of a paint can, the body 12 of the present invention may optionally comprise a first ear 104 and a second ear 106 as depicted in FIGS. 7A and 7B. Each of the first and second ears 104, 106 comprise a handle hole 108 designed to accept a handle (not depicted) of either wire, of the type typically employed with prior art steel paint cans, or plastic. The interface between the handle and handle hole may allow rotation of the handle with respect to the ears 104, 106. The ears 104, 106 are molded integral with the body 12 using slides and pins to facilitate molding and stripping as will be recognized by one of ordinary skill in the art. It is contemplated, however, that handles may be attached to the container 10 without employing the first or second ears 104, 106.

In one embodiment, the body upper end 94 is affixed into the ring annular channel 34 by standard spin welding techniques known to one of ordinary skill in the art. The notches 22 in the ring 14 allow for positive engagement with the spin welding chuck (not depicted). In one embodiment, it has been found that the ring 14 may be sufficiently secured to the sidewall 92 by interfacing the two with the ring 14 revolving at 1,100 RPM and 45 pounds force and allowing ⅔ of a revolution after interface. When employing spin welding, an extra 0.005–0.010 inches of sidewall 92 may be necessary in addition to the 7.370 inches described above for sacrifice to the spin welding. Other means of attaching the ring 14 to the body 12 such as plate or sonic welding, adhesives and mechanical locks are also contemplated. Alternatively, the body 12 and the ring 14 could be injection molded as a single piece thus eliminating the need for affixing one to the other. As will be recognized by one of ordinary skill in the art, molding the body 12 and the ring 14 together could be accomplished by, for example, collapsible-core mold. Whether the ring 14 and the body 12 are injected together or separately, the ring flange 32 at the ring outer diameter 30 is wider than any portion of the sidewall 92 so that when a plurality of containers 10 are grouped together, the ring flanges 32 of the respective containers 10 will contact one another rather than the sidewall 92 or any labels thereon. The integrity of the sidewalls 92 of the various containers 10 and the aesthetics of any labels thereon are not jeopardized.

Regardless of the manner in which the ring 14 is affixed to the body 12, the dimensions and shape of the container 10 are designed to hold 133 fluid ounces of water at ambient conditions (68 D.F.), as standard within the paint container industry, when the container 10 is intended for use as a paint container. In one embodiment, these conditions would provide a liquid level measured at 13/64 inches below the peak 54 of the ring jaw 38 to optimize the use of the volumetric capacity of the container 10.

Once affixed to the body 12, the ring 14 provides the container 10 with sufficient hoop strength to withstand the rigors to which a paint can is typically subjected. Specifically, the ring 14 must afford the container 10 sufficient hoop strength to prevent undue distortion or ovaling of the container 10 when handled by, for example, an automated labeling machine or a Bail-O-Matic machine as will be recognized by one of ordinary skill in the art. The present ring 14 therefore has an outer diameter 30 and a width (as measured from the ring outer diameter 30 to the adjacent ring third sealing diameter 60) to provide the container 10 with a high hoop strength. It has been found that a ring having an outer diameter 30 of 6 23/32 inches and a width of ⅝ inches will provide the container 10 with sufficient hoop strength for these purposes. The high hoop strength provided by these features eliminates the necessity of exterior ribs employed by prior containers to increase hoop strength. These exterior ribs collected dust and other substances that detracted from the aesthetics of the prior containers.

To further facilitate use of the present container 10 within automated equipment standard to the paint container industry, the radius of the ring outer diameter 30 and the body outer bead 100 may be within 1/32 inch of each other to assist the container in proceeding properly through standard labeling machines. Other dimensional relationships that may be desirable to facilitate use of standard equipment in the industry will be recognized by one of ordinary skill in the art.

Figure 8B:
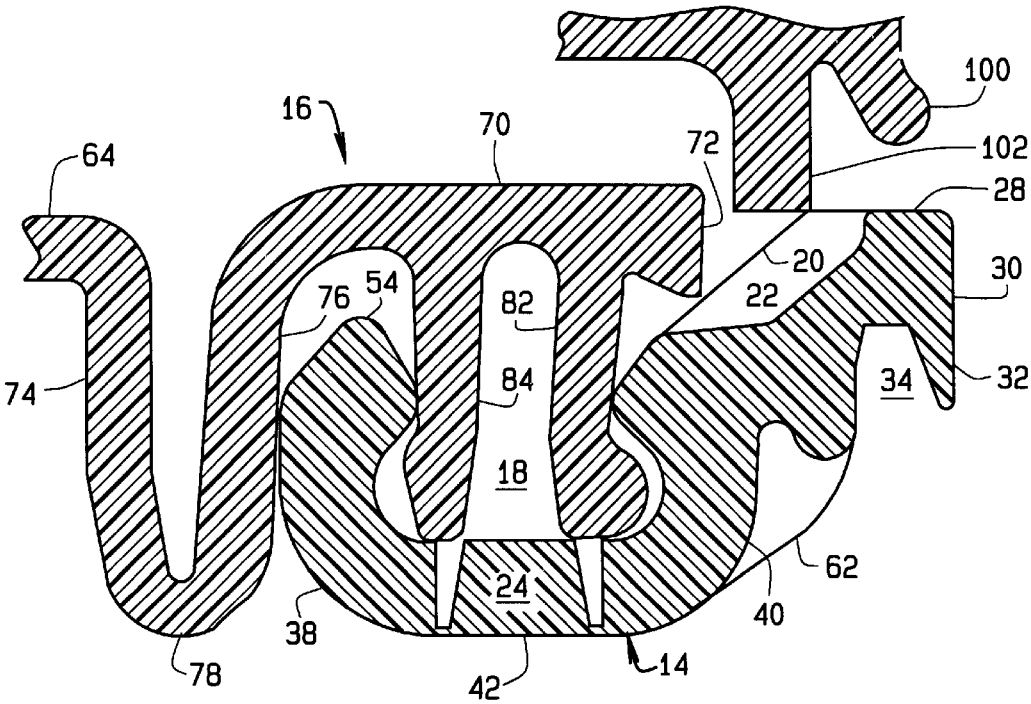
FIG. 8B is a take out from FIG. 8A indicated at 8B.

As depicted in FIGS. 8A–B, the diameter of the inner bead 102 is designed to rest, at least in part, on the ring upper land 28 when the containers 10 are stacked one on top of the others. The overall height of the plug 16, as measured from the uppermost surface of the lip 70 to the lowermost portions of the first and second locking tabs 86, 88, is slightly taller than the depth of the ring 14, as measured from the ring upper land 28 to the bottom of the groove 18, so that the plug "bottoms" on the ring groove and the plug lip 70 projects above the ring upper land 28. Thus configured, the plug lip outer diameter 72 of a lower container 10 interlocks with the inner annular bead 102 of an upper container stacked immediately thereon to prevent stacked containers 10 from inadvertently sliding off of one another.

Figure 9:
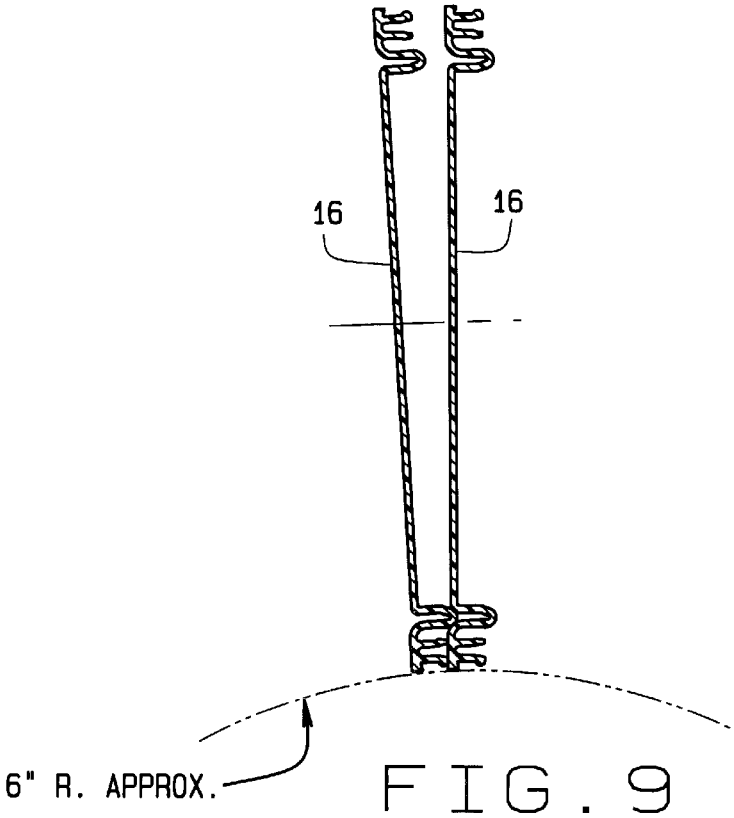
FIG. 9 is a cross-sectional view of two closure plugs, as depicted in FIG. 1, as they would appear in the trough of a lid dropper.

FIG. 9 depicts two plugs 16 of the present invention proceeding through a standard trough for a plug dropper. The profile of each plug U-shaped member 68 rests within that of the adjacent plug 16 and allows the plugs to move through the plug dropper equipment, and to be manually loaded into this equipment, properly so the plugs do not jam. Specifically, the contour of the plug U-shaped member 68 allows each plug 16 to rotate relative to each other without excessive separation or jamming.

In one embodiment, the plug 16 is injection molded according to standard injection molding techniques known to those of ordinary skill in the art. A plug mold employing a moveable stripper ring, as will be understood by one of ordinary skill in the art, may be employed and the mold could optionally include slides as well. Plug mold stripper rings facilitate molding of the first and second locking arms 82, 84. Similarly, the ring 14 may be injection molded according to standard injection molding techniques known to those of ordinary skill in the art. A ring mold employing a moveable stripper ring may be employed and the ring mold could optionally include slides as well. The ring mold stripper rings facilitate molding the ring first and second undercuts 46, 52.

It will be understood by one of ordinary skill in the art that the embodiments of the invention shown and described herein is not intended to illustrate all possible embodiments thereof. Modifications may be made to the embodiments described herein without departing from the scope of the present invention. It will also be understood that the terms employed herein are terms of description rather than limitation, and that various changes may be made without departing from the spirit and scope of the invention as disclosed.

We claim:

1. A container comprising:

a body;

a ring extending about an upper end of the body and defining a groove therein having a first undercut and a second undercut; and a plug comprising a first locking arm extending from the plug adjacent to the perimeter thereof and having a first locking tab adjacent to the distal end of the first locking arm, and a second locking arm extending from the plug inward of the first locking arm from the plug perimeter and comprising a second locking tab adjacent to the distal end of the second locking arm and configured to selectively reside within the second undercut, the first and second locking arms selectively receivable within the groove to locate the respective first and second locking tabs within the respective first and second undercuts for selectively securing the plug to the ring.

2. The container of claim 1 wherein the ring further has a first sealing diameter and a second sealing diameter defining an entrance to the groove, the first locking arm configured to be biased against the first sealing diameter and the second locking arm configured to be biased against the second sealing diameter when the first and second locking arms are received within the ring, a first seal being defined between the plug and the ring when the first locking arm is biased against the first sealing diameter.

3. The container of claim 2 wherein a second seal between the plug and the ring is defined when the second locking arm is biased against the second sealing diameter.

4. The container of claim 3 wherein the plug includes a U-shaped member with a lip extending therefrom, the first and second locking arms extending from the lip.

5. The container of claim 1 wherein the ring further includes a first sealing diameter and a second sealing diameter defining an entrance to the groove, a first angled centering ledge extending above the first sealing diameter and configured to direct the first locking arm into the groove, and an angled ledge extending above the second sealing diameter and configured to direct the second locking arm into the groove.

6. The container of claim 5 in which the plug further comprises a U-shaped member extending from a disc and a lip extending from the U-shaped member, the first and second locking arms extending from the lip.

7. The container of claim 6 which the U-shaped member has an angled ledge and the ring has a second angled centering ledge for directing the U-shaped member away from the groove.

8. The container of claim 1 in which the plug and ring are formed of a polymer material.

9. The container of claim 1 in which the ring has at least one drain tab for selective displacement from the groove to create a drain hole.

10. The container of claim 1 wherein the first locking tab protrudes farther from the first locking arm than the second locking tab from the second locking arm.

11. A container comprising:

a body;

a ring extending about an upper end of the body and defining a groove therein having a first undercut and a second undercut; and a plug comprising a disc and a sealing member extending about the perimeter of the disc, the sealing member comprising a lip and a first locking arm extending from the lip, a second locking arm extending from the lip inward of the first locking arm from the plug perimeter, the first locking arm having a first locking tab adjacent the distal end thereof and the second locking arm a second locking tab adjacent the distal end thereof, the first and second locking arms selectively receivable within the groove to locate the first locking tab within the first undercut and the second locking tab within the second undercut for selectively securing the plug to the ring.

12. The container of claim 11 wherein the ring further has a first sealing diameter and a second sealing diameter defining an entrance to the groove, the first locking arm configured to be biased against the first sealing diameter and the second locking arm configured to be biased against the second sealing diameter when the first and second locking arms are received within the ring, a first seal being defined between the plug and the ring when the first locking arm is biased against the first sealing diameter.

13. The container of claim 12 which a second seal between the plug and the ring is defined when the second locking arm is biased against the second sealing diameter.

14. The container of claim 11 in which the ring further has a first sealing diameter and a second sealing diameter defining an entrance to the groove, a first angled centering ledge extending above the first sealing diameter and configured to direct the first locking arm into the groove, and a second angled centering ledge extending above the second sealing diameter and configured to direct the second locking arm into the groove.

15. The container of claim 11 in which the plug and ring are formed of a polymer material.

16. The container of claim 11 in which the first locking tab protrudes farther from the first locking arm than the second locking tab from the second locking arm.

* * * * *

UNITED STATES PATENT AND TRADEMARK OFFICE

CERTIFICATE OF CORRECTION

PATENT NO. : 6,491,185 B1 
DATED : December 10, 2002
INVENTOR(S) : Francis T. Azzarello and Radolfo Q. Raymundo, Jr.

It is certified that error appears in the above-identified patent and that said Letters Patent is hereby corrected as shown below:

Column 2,
Line 12, “angel” should be -- angle --.

Column 3,
Line 2, after “constructed” and before “a” insert -- of --.

Column 14,
Line 44, after “12” and before “which insert -- in --.

Signed and Sealed this

Fifth Day of August, 2003

JAMES E. ROGAN
*Director of the United States Patent and Trademark Office*